US006932588B2

(12) United States Patent
Choi et al.

(10) Patent No.: US 6,932,588 B2
(45) Date of Patent: Aug. 23, 2005

(54) VARIABLE CAPACITY ROTARY COMPRESSOR

(75) Inventors: Jin Kyu Choi, Suwon (KR); Young Ho Kim, Gimhae (KR)

(73) Assignee: Samsung Electornics Co., Ltd., Suwon-si (KR)

( * ) Notice: Subject to any disclaimer, the term of this patent is extended or adjusted under 35 U.S.C. 154(b) by 0 days.

(21) Appl. No.: 10/448,419

(22) Filed: May 30, 2003

(65) Prior Publication Data

US 2004/0131490 A1 Jul. 8, 2004

(30) Foreign Application Priority Data

Jan. 6, 2003 (KR) ..... 10-2003-0000554

(51) Int. Cl.[7] ..... F03C 2/00

(52) U.S. Cl. ..... 418/63; 418/1; 418/16; 418/180; 418/270; 417/213; 417/440

(58) Field of Search ..... 417/213, 440; 418/1, 16, 63, 180, 270

(56) References Cited

U.S. PATENT DOCUMENTS 2,047,167 A * 7/1936 Heller ..... 417/274
3,354,790 A * 11/1967 Race ..... 92/60.5
4,068,562 A * 1/1978 Frenkel ..... 92/60.5
5,871,342 A 2/1999 Harte et al. ..... 418/6
6,551,069 B2 * 4/2003 Narney et al. ..... 417/53

FOREIGN PATENT DOCUMENTS

JP 55-98690 * 7/1980 ..... 417/440
JP 2-136589 * 5/1990 ..... 418/127

* cited by examiner

*Primary Examiner*—Theresa Trieu
(74) *Attorney, Agent, or Firm*—Staas & Halsey LLP

(57) ABSTRACT

A variable capacity rotary compressor includes a housing defining a cylindrical compression chamber therein and having an inlet port and an outlet port communicating with the compression chamber. A rotating shaft is provided with an eccentric part to rotate in the compression chamber. A ring piston is rotatably fitted over the eccentric part such that an outer surface of the ring piston is in contact with an inner surface of the compression chamber. A vane is installed in the housing so as to be in contact with the outer surface of the ring piston and radially reciprocates, and partitions the compression chamber into an intake part and a discharging part. A re-expansion space communicates with the compression chamber, and receives refrigerant therein. A control unit opens or closes an inlet of the re-expansion space to vary a capacity of the rotary compressor.

31 Claims, 3 Drawing Sheets

VARIABLE CAPACITY ROTARY COMPRESSOR

CROSS-REFERENCE TO RELATED APPLICATION

This application claims the benefit of Korean Application No. 2003-554, filed Jan. 6, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a rotary compressor which is capable of varying a compression capacity of the compressor as desired.

2. Description of the Related Art

As is well known to those skilled in the art, a rotary compressor is a machine which compresses refrigerant in a variety of refrigeration systems, such as air conditioners and refrigerators. The rotary compressor includes a housing which is provided with a cylindrical compression chamber, and a ring piston which is arranged in the housing and is eccentrically rotated. The rotary compressor further includes a vane. The vane is installed in the housing so as to be in contact with an outer surface of the ring piston, reciprocates in a radial direction of the compression chamber, and partitions the housing into an intake part communicating with an inlet port thereof and a discharging part communicating with an outlet port thereof. In the rotary compressor, when the ring piston installed in the compression chamber is eccentrically rotated by a drive motor, refrigerant is sucked into the compression chamber from the inlet port and is highly pressurized prior to being discharged from the compression chamber through the outlet port. The refrigerant is thus compressed.

The conventional rotary compressor has an advantage that a compressing efficiency thereof is high. However, the conventional rotary compressor has a problem that a compression capacity of the compressor is difficult to control as desired, so to use the rotary compressor is difficult in refrigeration systems, such as refrigerators and air conditioners, which need to vary the cooling capacities thereof.

SUMMARY OF THE INVENTION

Accordingly, it is an aspect of the present invention to provide a variable capacity rotary compressor which easily varies a compression capacity thereof.

Additional aspects and/or advantages of the invention will be set forth in part in the description which follows and, in part, will be obvious from the description, or may be learned by practice of the invention.

The above and/or other aspects are achieved by providing a variable capacity rotary compressor, including a housing, a rotating shaft, a ring piston, a vane, a re-expansion space, and a control unit. The housing defines a cylindrical compression chamber therein, and has an inlet port and an outlet port communicating with the compression chamber. The rotating shaft is provided with an eccentric part which is rotated in the compression chamber. The ring piston is rotatably fitted over the eccentric part of the rotating shaft such that an outer surface of the ring piston is in contact with an inner surface of the compression chamber. The vane is installed in the housing so as to be in contact with the outer surface of the ring piston, reciprocates in a radial direction of the compression chamber, and partitions the compression chamber into an intake part communicating with the inlet port and a discharging part communicating with the outlet port. The re-expansion space is defined at a position which is spaced apart from the inlet port by a predetermined interval so as to communicate with the compression chamber, and receives a predetermined amount of refrigerant therein. The control unit opens or closes an inlet of the re-expansion space so as to vary a capacity of the rotary compressor.

The re-expansion space is defined in an extension pipe, the extension pipe having a predetermined length and mounted to the housing to communicate with the compression chamber.

The control unit includes a piston receiving part, a control piston, a first control path, a second control path, a third control path, and a path control valve. The piston receiving part is provided at a position around the inlet of the re-expansion space. The control piston is installed in the piston receiving part to reciprocate in the piston receiving part, opening or closing the inlet of the re-expansion space. The first control path communicates with an interior of the piston receiving part. The second control path connects a discharging side of the rotary compressor to the first control path. The third control path connects an intake side of the rotary compressor to the first control path. The path control valve is provided at a junction between the first, second, and third control paths.

The path control valve comprises a three-way valve connecting the first control path either to the second control path or the third control path.

A spring is installed in the piston receiving part, and operates to bias the control piston to keep the inlet of the re-expansion space open when the piston receiving part communicates with the intake side of the rotary compressor.

A plurality of volume control valves are provided at predetermined positions of the extension pipe so as to be spaced apart from each other, and stepwise vary a volume of the re-expansion space which communicates with the compression chamber.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
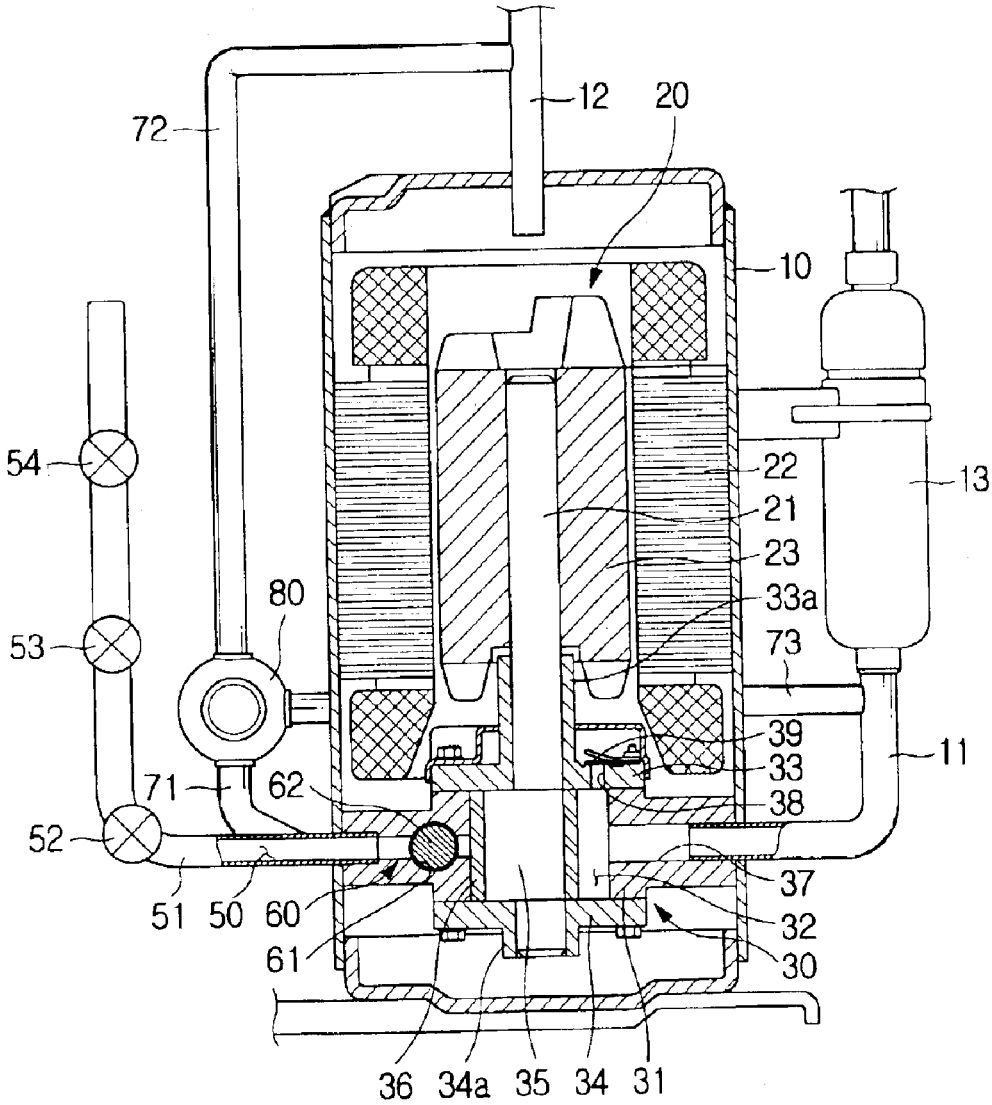
FIG. 1 is a sectional view illustrating a variable capacity rotary compressor, according to an embodiment of the present invention.

Reference will now be made in detail to the present preferred embodiment of the present invention, examples of which are illustrated in the accompanying drawings, wherein like reference numerals refer to like elements throughout.

Figure 2:
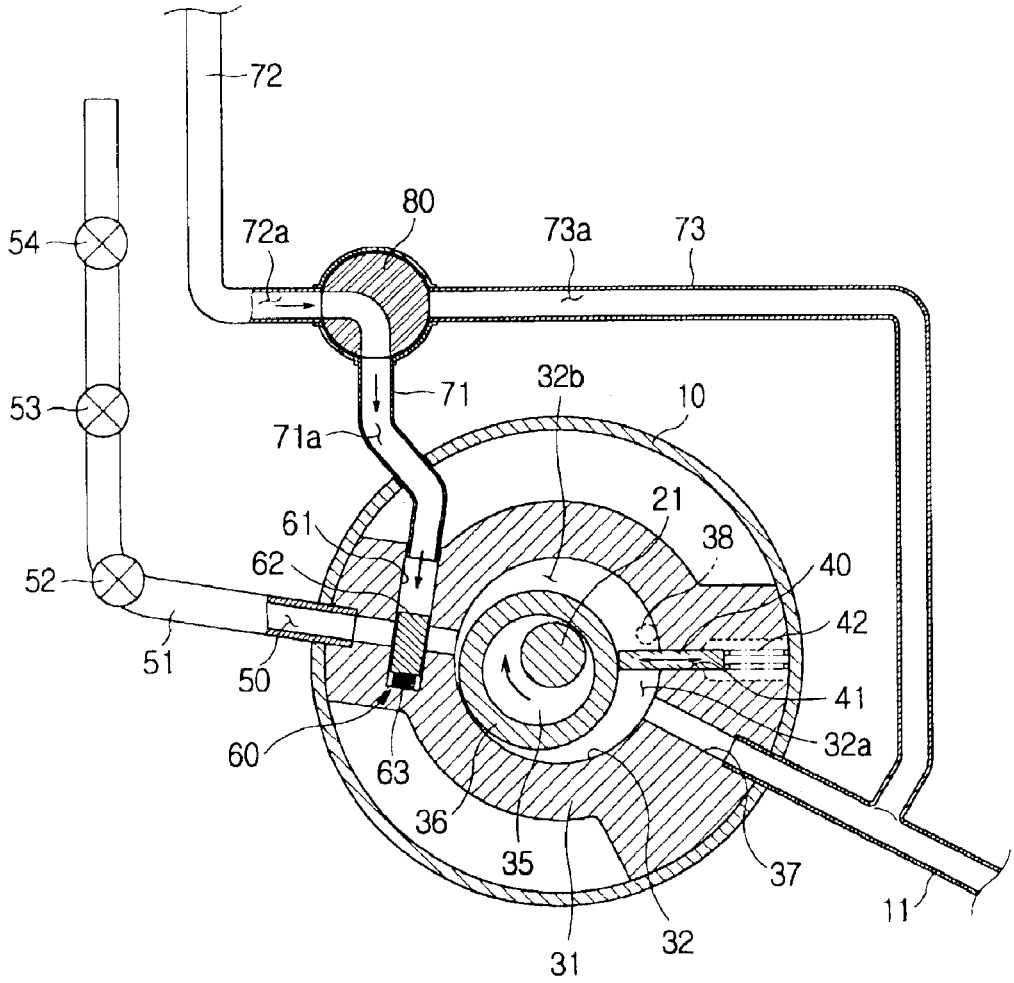
FIG. 2 is a sectional view of the variable capacity rotary compressor, according to the embodiment of the present invention, when an inlet of a re-expansion space included in the rotary compressor is closed.

As illustrated in FIGS. 1 and 2, a variable capacity rotary compressor according to an embodiment of the present invention includes a hermetic casing 10. A drive unit 20 and a compressing unit 30 are installed in the hermetic casing 10. The drive unit 20 generates a rotating force, and the compressing unit 30 is connected to the drive unit 20 via a rotating shaft 21.

The drive unit 20 includes a cylindrical stator 22, and a rotor 23. The cylindrical stator 22 is fixedly mounted to an inner surface of the hermetic casing 10. The rotor 23 is rotatably installed in the hermetic casing 10 to surround the rotating shaft 21 which is provided at a center of the hermetic casing 10.

The compressing unit 30 includes a housing 31, and upper and lower flanges 33 and 34, respectively. The housing 31 defines a cylindrical compression chamber 32 therein, and is fixed at an outer surface thereof to the inner surface of the hermetic casing 10. The upper and lower flanges 33 and 34 are mounted to upper and lower portions of the housing 31, respectively, to close open upper and lower portions of the cylindrical compression chamber 32 and rotatably support the rotating shaft 21. The upper and lower flanges 33 and 34 are provided with first and second shaft mounting bosses 33*a* and 34*a*, respectively.

The rotating shaft 21, installed in the cylindrical compression chamber 32, is provided with an eccentric part 35. A ring piston 36 is rotatably fitted over the eccentric part 35 of the rotating shaft 21. In this case, the ring piston 36 is eccentrically rotated such that an outer surface thereof is in contact with an inner surface of the cylindrical compression chamber 32.

An inlet port 37 is provided at a predetermined position of the housing 31 to communicate with the compression chamber 32. A refrigerant inlet pipe 11 is connected to the inlet port 37 to guide refrigerant so that low-temperature and low-pressure refrigerant flows into the inlet port 37 from an evaporator (not shown) of a general refrigeration system. An accumulator 13 is provided at a predetermined position of the refrigerant inlet pipe 11.

The upper flange 33 is provided with an outlet port 38 so that the cylindrical compression chamber 32 communicates with the interior of the hermetic casing 10 through the outlet port 38. A discharging valve 39 is mounted to an outlet side of the outlet port 38. A refrigerant outlet pipe 12 is mounted at an upper portion of the hermetic casing 10 to guide refrigerant so that the compressed refrigerant is discharged from the hermetic casing 10 to a condenser (not shown) of the refrigeration system.

As illustrated in FIG. 2, the rotary compressor includes a vane 40. The vane 40 is slidably installed in the housing 31. When the ring piston 36 is rotated, the vane 40 reciprocates in a radial direction of the cylindrical compression chamber 32 to partition the cylindrical compression chamber 32 into an intake part 32*a* communicating with the inlet port 37 and a discharging part 32*b* communicating with the outlet port 38. The discharging part 32*b* is used as a compressing part where the refrigerant is compressed. A vane support recess 41 is formed at a predetermined position of the housing 31, and receives the vane 40 therein so as to allow the vane 40 to reciprocate in the radial direction of the cylindrical compression chamber 32. A vane spring 42 is provided in the vane support recess 41 to bias the vane 40 toward the ring piston 36.

When the eccentric part 35 of the rotating shaft 21 is rotated, the ring piston 36 is eccentrically rotated in the cylindrical compression chamber 32 to suck the refrigerant from the inlet port 37 and pressurize the refrigerant prior to being discharged through the outlet port 38.

Further, a tubular re-expansion space 50 is defined at a position diametrically opposite to the inlet port 37, and communicates with the cylindrical compression chamber 32. In this case, the tubular re-expansion space 50 is defined in an extension pipe 51 which has a predetermined length to extend to a predetermined position outside the hermetic casing 10 and has a shape of a general refrigerant pipe. When the refrigerant is compressed, a part of the refrigerant which exists in the discharging part 32*b* is received into the tubular re-expansion space 50, and thereafter, expands into the intake part 32*a*, thus reducing the compression capacity. In this case, the extension pipe 51, which extends to the outside of the hermetic casing 10, is closed at an end thereof.

To vary compression capacity of the rotary compressor, the rotary compressor includes a control unit 60, and a plurality of volume control valves 52, 53, and 54. The control unit 60 opens or closes an inlet of the tubular re-expansion space 50. The volume control valves 52, 53, and 54 are provided at predetermined positions of the extension pipe 51 which extends to the outside of the hermetic casing 10, and stepwise vary a volume of the tubular re-expansion space 50.

As shown in FIG. 2, the control unit 60 includes a piston receiving part 61, a control piston 62, and a spring 63. The piston receiving part 61 is provided at a position around the inlet of the tubular re-expansion space 50 in the housing 31. The control piston 62 reciprocates in the piston receiving part 61 to open or close the inlet of the tubular re-expansion space 50. The spring 63 is installed in the piston receiving part 61 to bias the control piston 62. When an external force is not applied to the control piston 62, the spring 63 biases the control piston 62 to keep the inlet of the re-expansion space 61 open.

The control unit 60 further includes a first control pipe 71, a second control pipe 72, and a third control pipe 73. The first control pipe 71 defines a first control path 71*a* which communicates with the piston receiving part 61, and is connected at one end thereof to the piston receiving part 61 and extends at a second end thereof to the outside of the hermetic casing 10. The second control pipe 72 defines a second control path 72*a* which connects a discharging side of the rotary compressor to the first control path 71*a*. The second control pipe 72 branches off from the refrigerant outlet pipe 12, and is connected to the first control pipe 71. The third control pipe 73 defines a third control path 73*a* which connects an intake side of the rotary compressor to the first control path 71*a*. The third control pipe 73 branches off from the refrigerant inlet pipe 11, and is connected to a junction between the first and second control pipes 71 and 72. A path control valve 80 is provided at the junction between the first, second, and third control pipes 71, 72, and 73 to selectively connect the first control path 71*a* to the second or third control path 72*a* or 73*a*. The path control valve 80 comprises a three-way valve which is controlled in response to an electrical signal transferred from a control switch (not shown).

Figure 3:
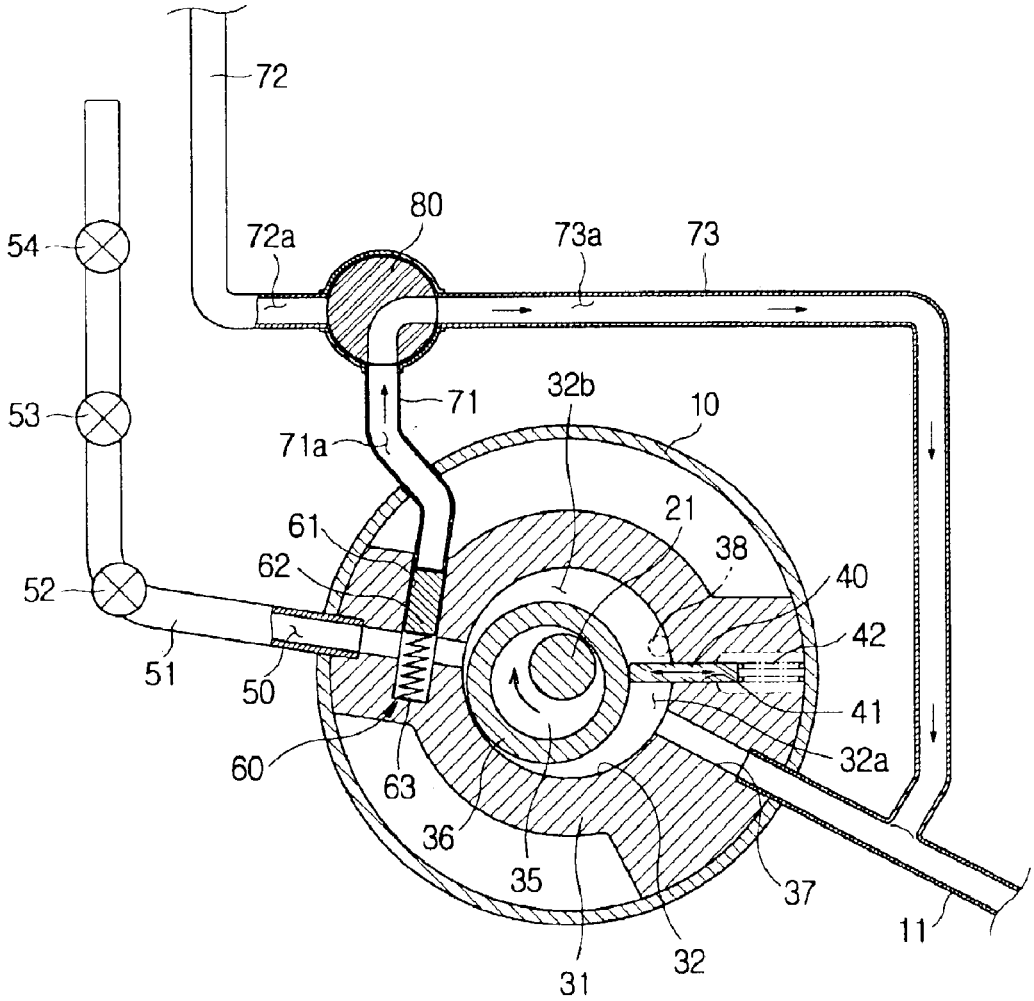
FIG. 3 is a sectional view of the variable capacity rotary compressor, according to the embodiment of the present invention, when the inlet of the re-expansion space is open.

Thus, when the first control path 71*a* communicates with the second control path 72*a* by the path control valve 80 as illustrated in FIG. 2, the control piston 62 is operated to close the inlet of the tubular re-expansion space 50 due to pressure from the discharging side of the rotary compressor acting on the control piston 62. Further, as illustrated in FIG. 3, when the first control path 71*a* communicates with the third control path 73*a* by the path control valve 80 and pressure from the refrigerant inlet pipe 11 is provided to act in the piston receiving part 61, the control piston 62 is moved toward the first control pipe 71 in a direction opposite to the case illustrated in FIG. 2 due to a low pressure of the intake side of the rotary compressor acting on the control piston 62, thus opening the inlet of the tubular re-expansion space 50.

Each of the volume control valves 52, 53, and 54, provided at predetermined positions of the extension pipe 51, comprises a solenoid valve which is operated in response to an electrical signal transferred from a control switch (not shown) to open or close the extension pipe 51. The volume control valves 52, 53, and 54 may comprise a first volume control valve 52, a second volume control valve 53, and a third volume control valve 54 which are provided at the extension pipe 51 so as to be spaced apart from each other by a predetermined interval. Such a construction allows the tubular re-expansion space 50 to selectively communicate with the cylindrical compression chamber 32 by operation of the control unit 60 and the first, second and third volume control valves 52, 53, and 54, thus varying the compression capacity of the rotary compressor as desired.

The operation of the variable capacity rotary compressor according to the embodiment of the present invention will be described in the following.

When one desires to increase the compression capacity, as illustrated in FIG. 2, the path control valve 80 is operated to connect the second control path 72*a* to the first control path 71*a* to communicate the discharging side of the rotary compressor with the first control path 71*a*. At this time, the control piston 62 is operated to close the inlet of the tubular re-expansion space 50 by the pressure of the discharging side of the rotary compressor.

When the rotary compressor is operated in such a state, the rotating shaft 21 is rotated and the ring piston 36 is eccentrically rotated in the cylindrical compression chamber 32 by the eccentric part 35 of the rotating shaft 21. At this time, the vane 40 reciprocates in the radial direction of the cylindrical compression chamber 32. As the ring piston 36 is rotated and the vane 40 reciprocates, the volumes of the intake part 32*a* and the discharging part 32*b* which constitute the cylindrical compression chamber 32 are continuously varied, while the low-pressure refrigerant sucked through the inlet port 37 is pressurized prior to being discharged through the outlet port 38. The high-pressure refrigerant, discharged through the refrigerant outlet pipe 12, passes through the second control path 72*a* and the first control path 71*a*, and then flows into the piston receiving part 61. At this time, the refrigerant pressurizes the first control path 71*a* and moves the control piston 62 to close the inlet of the tubular re-expansion space 50, so the tubular re-expansion space 50 does not communicate with the cylindrical compression chamber 32. In this case, the refrigerant is compressed throughout the cylindrical compression chamber 32 by a rotation of the ring piston 36, thus maximizing the compression capacity of the rotary compressor.

Further, when one desires to reduce the compression capacity, as illustrated in FIG. 3, the path control valve 80 is operated to connect the third control path 73*a* to the first control path 71*a*. In this case, the second control path 72*a* is closed, and the piston receiving part 61 communicates with the intake side of the rotary compressor having a low pressure via the third control path 73*a*. At this time, the control piston 62 is moved toward the first control pipe 71 in a direction opposite to the case illustrated in FIG. 2 by an elasticity of the spring 63, so the inlet of the tubular re-expansion space 50 is opened, and the tubular re-expansion space 50 communicates with the cylindrical compression chamber 32.

When the refrigerant is compressed by the rotation of the ring piston 36 in such a state, a part of the refrigerant which exists in the cylindrical compression chamber 32 flows into the tubular re-expansion space 50, so the compression capacity of the rotary compressor is reduced proportionally. That is, the refrigerant existing in the discharging part 32*b* is started to be compressed after the ring piston 36, which rotates, passes the inlet of the tubular re-expansion space 50, so that the compressing capacity of the compressor is reduced. Further, the refrigerant received in the tubular re-expansion space 50 re-expands into the intake part 32*a*, so an intake amount of the refrigerant is reduced, thus reducing the compression capacity of the rotary compressor.

When one desires to further reduce the compression capacity of the rotary compressor, the control piston 62 is operated to open the inlet of the tubular re-expansion space 50 while the first volume control valve 52 is opened. When the rotary compressor is operated in such a state, a volume of the tubular re-expansion space 50 is further increased, thus further reducing the compression capacity. Furthermore, when the second volume control valve 53 or the second and third volume control valves 53 and 54 are opened, the compression capacity is further reduced, thus allowing the compression capacity to be stepwise varied.

As is apparent from the above description, a variable capacity rotary compressor is provided, which is designed such that a cylindrical compression chamber communicates with a tubular re-expansion space by opening an inlet of the tubular re-expansion space, thus varying a compression capacity as desired and easily controlling a cooling capacity of refrigeration systems, such as refrigerators and air conditioners.

Further, a variable capacity rotary compressor is provided, which increases or reduces a volume of a tubular re-expansion space by selectively opening or closing a plurality of volume control valves which are provided at an extension pipe, thus allowing the compression capacity to be stepwise varied.

Although an preferred embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A variable capacity rotary compressor, comprising:

a housing defining a cylindrical compression chamber therein, and having an inlet port and an outlet port communicating with the cylindrical compression chamber;

a rotating shaft provided with an eccentric part which rotates in the compression chamber;

a ring piston rotatably fitting over the eccentric part of the rotating shaft such that an outer surface of the ring piston is in contact with an inner surface of the cylindrical compression chamber;

a vane disposed in the housing so as to be in contact with the outer surface of the ring piston and reciprocating in a radial direction of the cylindrical compression chamber, the vane partitioning the cylindrical compression chamber into an intake part communicating with the inlet port and a discharging part communicating with the outlet port;

a re-expansion space, having a variable volume, defined at a position which is spaced apart from the inlet port by a predetermined interval so as to communicate with the cylindrical compression chamber, the re-expansion space receiving a predetermined amount of refrigerant therein; and a control unit to open or to close an inlet of the re-expansion space so as to vary a capacity of the variable capacity rotary compressor.

2. The variable capacity rotary compressor according to claim 1, further comprising:

an extension pipe with a predetermined length being mounted to the housing to communicate with the cylindrical compression chamber and the re-expansion space being defined in the extension pipe.

3. A variable capacity rotary compressor, comprising:

a housing defining a cylindrical compression chamber therein, and having an inlet port and an outlet port communicating with the cylindrical compression chamber;

a rotating shaft provided with an eccentric part which rotates in the compression chamber;

a ring piston rotatably fitting over the eccentric part of the rotating shaft such that an outer surface of the ring piston is in contact with an inner surface of the cylindrical compression chamber;

a vane disposed in the housing so as to be in contact with the outer surface of the ring piston and reciprocating in a radial direction of the cylindrical compression chamber, the vane partitioning the cylindrical compression chamber into an intake part communicating with the inlet port and a discharging part communicating with the outlet port;

a re-expansion space defined at a position which is spaced apart from the inlet port by a predetermined interval so as to communicate with the cylindrical compression chamber, the re-expansion space receiving a predetermined amount of refrigerant therein; and a control unit to open or to close an inlet of the re-expansion space so as to vary a capacity of the variable capacity rotary compressor, wherein said control unit comprises:

a piston receiving part provided at a position around the inlet of the re-expansion space, a control piston disposed in the piston receiving part to reciprocate in the piston receiving part and opening or closing the inlet of the re-expansion space, a first control path communicating with an interior of the piston receiving part, a second control path to connect a discharging side of the variable capacity rotary compressor to the first control path, a third control path to connect an intake side of the variable capacity rotary compressor to the first control path, and a path control valve provided at a junction between the first, second, and third control paths.

4. The variable capacity rotary compressor according to claim 3, wherein the path control valve comprises:

a three-way valve connecting the first control path to one of the second control path and the third control path.

5. The variable capacity rotary compressor according to claim 3, further comprising:

a spring disposed in the piston receiving part to bias the control piston to keep the inlet of the re-expansion space open when the piston receiving part communicates with the intake side of the variable capacity rotary compressor.

6. A variable capacity rotary compressor, comprising:

a housing defining a cylindrical compression chamber therein, and having an inlet port and an outlet port communicating with the cylindrical compression chamber;

a rotating shaft provided with an eccentric part which rotates in the compression chamber;

a ring piston rotatably fitting over the eccentric part of the rotating shaft such that an outer surface of the ring piston is in contact with an inner surface of the cylindrical compression chamber;

a vane disposed in the housing so as to be in contact with the outer surface of the ring piston and reciprocating in a radial direction of the cylindrical compression chamber, the vane partitioning the cylindrical compression chamber into an intake part communicating with the inlet port and a discharging part communicating with the outlet port;

a re-expansion space defined at a position which is spaced apart from the inlet port by a predetermined interval so as to communicate with the cylindrical compression chamber, the re-expansion space receiving a predetermined amount of refrigerant therein;

a control unit to open or to close an inlet of the re-expansion space so as to vary a capacity of the variable capacity rotary compressor;

an extension pipe with a predetermined length being mounted to the housing to communicate with the cylindrical compression chamber and the re-expansion space being defined in the extension pipe; and a plurality of volume control valves provided at predetermined positions along the extension pipe so as to be spaced apart from each other, the volume control valves stepwise varying a volume of the re-expansion space which communicates with the cylindrical compression chamber.

7. A variable capacity rotary compressor, comprising:

a housing defining a compression chamber therein, and having a partition, an inlet port and an outlet port, the inlet port and the outlet port communicating with the compression chamber;

a rotating part eccentrically rotating in the compression chamber, the partition disposed in the housing and in contact with the rotating part, partitioning the compression chamber into an intake part communicating with the inlet port and a discharging part communicating with the outlet port;

a re-expansion space, having a variable volume, communicating with the compression chamber; and a control unit opening or closing an inlet of the re-expansion space to vary a capacity of the variable capacity rotary compressor.

8. A variable capacity rotary compressor, comprising:

a housing having a compression chamber therein with inlet and outlet ports;

intake and discharging parts, respectively, communicating with the inlet port and the outlet port;

a rotating part rotating in the compression chamber;

a partition to separate the intake and discharge parts while in contact with the rotating part; and a expansion unit having an expansion space with a variable volume therein communicating with the compression chamber; and a control unit opening or closing an inlet of the expansion space to vary a capacity of the variable capacity rotary compressor.

9. A variable capacity rotary compressor, comprising:

a housing having a compression chamber therein with inlet and outlet ports;

intake and discharging parts, respectively, communicating with the inlet port and the outlet port;

a rotating part rotating in the compression chamber;

a partition to separate the intake and discharge parts while in contact with the rotating part; and an expansion unit having an expansion space with a variable volume therein communicating with the compression chamber; and one or more expansion valves positioned to open or to close one or more portions of the expansion space to vary a capacity of the variable capacity rotary compressor.

10. The variable capacity rotary compressor according to claim 9, wherein the discharging part is provided as a compressing part such that refrigerant introduced therein is compressed.

11. The variable capacity rotary compressor according to claim 9, wherein the partition is slidably disposed in the housing.

12. The variable capacity rotary compressor according to claim 11, further comprising:

a recess formed at a predetermined position in the housing to receive the partition therein so as to allow the partition to reciprocate in a radial direction of the compression chamber; and a partition spring provided in the recess to bias the partition toward the rotating part.

13. The variable capacity rotary compressor according to claim 9, wherein when the rotating part is rotated, refrigerant introduced from the inlet port is pressurized prior to being discharged through the outlet port.

14. The variable capacity rotary compressor according to claim 9, wherein the expansion unit is provided at a position diametrically opposite to the inlet port.

15. The variable capacity rotary compressor according to claim 9, wherein:

the expansion unit is of a predetermined length; and the one or more expansion valves are disposed at predetermined positions to open or close, respectively, one or more portions of the expansion space in the expansion unit.

16. The variable capacity rotary compressor according to claim 9, further comprising:

a control unit to open or to close an inlet of the expansion unit to vary a capacity of the variable capacity rotary compressor.

17. The variable capacity rotary compressor according to claim 16, wherein the control unit comprises:

a receiving part having an inlet portion thereof provided at the inlet of the expansion unit; and a piston disposed in the receiving part to reciprocate therein to open or to close the inlet of the expansion unit.

18. The variable capacity rotary compressor according to claim 9, wherein when refrigerant is compressed by a rotation of the rotating part, a part of the refrigerant which exists in the compression chamber flows into the expansion space, so that a compression capacity of the variable capacity rotary compressor is reduced.

19. The variable capacity rotary compressor according to claim 9, wherein the one or more expansion valves control a volume of the expansion space.

20. The variable capacity rotary compressor according to claim 19, wherein the one or more expansion valves control the volume of the expansion space by being space apart along a length of the expansion unit and being selectively opened or closed to vary a volume of the expansion space in accordance with a respective one of the expansion valves, which is closest to the compressing chamber and closed.

21. The variable capacity rotary compressor according to claim 19, wherein the one or more expansion valves control the volume of the expansion space by being space apart along a length of the expansion unit and being opened or closed to change a volume of the expansion space by predetermined amounts in accordance with a respective one of the expansion valves, which is closest to the compressing chamber and closed.

22. The variable capacity rotary compressor according to claim 9, wherein each of the expansion valves is a solenoid valve.

23. A variable capacity rotary compressor, comprising:

a housing having a compression chamber therein with inlet and outlet ports;

intake and discharging parts, respectively, communicating with the inlet port and the outlet port;

a rotating part rotating in the compression chamber;

a partition to separate the intake and discharge parts while in contact with the rotating part; and an expansion unit having an expansion space therein communicating with the compression chamber;

one or more expansion valves positioned to open or to close one or more portions of the expansion space to vary a capacity of the variable capacity rotary compressor; and a control unit to open or to close an inlet of the expansion unit to vary a capacity of the variable capacity rotary compressor, wherein the control unit comprises:

a receiving part having an inlet portion thereof provided at the inlet of the expansion unit, a piston disposed in the receiving part to reciprocate therein to open or to close the inlet of the expansion unit, a first control path communicating with the inlet portion of the receiving part, a second control path to connect a discharging side of the variable capacity rotary compressor to the first control path, a third control path to connect an intake side of the variable capacity rotary compressor to the first control path, and a path control valve provided at a junction between the first, second, and third control paths to control the first, second and third control paths.

24. The variable capacity rotary compressor according to claim 23, wherein when the first control path connects to the second control path by the path control valve, the piston is operated to close the inlet of the expansion unit due to a pressure level from the discharging side of the rotary compressor acting on the piston.

25. The variable capacity rotary compressor according to claim 23, wherein the path control valve comprises:

a three-way valve connecting the first control path to one of the second control path and the third control path.

26. The variable capacity rotary compressor according to claim 23, wherein:

when the path control valve connects the first control path to the second control path, the piston disposed in the receiving part is positioned so as to open the inlet of the expansion unit; and when the path control valve connects the first control path to the third control path, the piston disposed in the receiving part is positioned so as to close the inlet of the expansion unit.

27. The variable capacity rotary compressor according to claim 23, further comprising:

a spring disposed in the receiving part to bias the piston to a position to open the inlet of the expansion unit when the receiving part communicates with the intake side of the variable capacity rotary compressor.

28. The variable capacity rotary compressor according to claim 27, wherein when the first control path connects to the third control path by the path control valve, the piston is operated by the spring to open the inlet of the expansion unit due to bias of the spring counteracting a pressure level from the intake side of the variable capacity rotary compressor acting on the piston.

29. A method of controlling a variable capacity rotary compressor having a compression chamber therein with a rotating part disposed in the compression chamber, the partition disposed in the housing and in contact with the rotating part, a re-expansion space having a variable volume communicating with the compression chamber, the method comprising:

eccentrically rotating the rotating part in the compression chamber partitioning the compression chamber into an intake part communicating with the inlet port and a discharging part communicating with the outlet port; and controlling opening or closing of an inlet of the re-expansion space, and the variable volume of the re-expansion space, to vary a capacity of the variable capacity rotary compressor.

30. A method of controlling a variable capacity rotary compressor, a housing thereof having a compression chamber therein with inlet and outlet ports, a rotating part, and intake and discharging parts, respectively, communicating with the inlet port and the outlet port, a variable volume expansion unit adjacent to and communicating with the compression chamber, the method comprising:

rotating the rotating part in the compression chamber;

separating the intake and discharge parts; and opening or closing an inlet of the expansion unit, and varying a volume of the expansion unit, to vary a capacity of the variable capacity rotary compressor.

31. A method of controlling a variable capacity rotary compressor, a housing thereof having a compression chamber therein with inlet and outlet ports, a rotating part, and intake and discharging parts, respectively, communicating with the inlet port and the outlet port, a variable volume expansion unit adjacent to and communicating with the compression chamber, the method comprising:

rotating the rotating part in the compression chamber;

separating the intake and discharge parts; and opening or closing one or more portions of the expansion unit, thereby varying a volume of the expansion unit, to vary a capacity of the variable capacity rotary compressor.

* * * * *

UNITED STATES PATENT AND TRADEMARK OFFICE

CERTIFICATE OF CORRECTION

PATENT NO. : 6,932,588 B2
APPLICATION NO. : 10/448419
DATED : August 23, 2005
INVENTOR(S) : Jin Kyu Choi et al.

It is certified that error appears in the above-identified patent and that said Letters Patent is hereby corrected as shown below:

On the Title Page, Item [73] Assignee, after "Samsung" replace "Electornics" with --Electronics--, therefor.

Signed and Sealed this

Twenty-second Day of January, 2008

JON W. DUDAS
*Director of the United States Patent and Trademark Office*